US012304539B2

(12) United States Patent
Liu et al.

(10) Patent No.: US 12,304,539 B2
(45) Date of Patent: May 20, 2025

(54) AUTOMATIC DRIVING METHODS, VEHICLE ON-BOARD CONTROLLERS, TRAFFIC CONTROL INTEGRATED AUTOMATION SYSTEMS, AND ZONE CONTROLLERS

(71) Applicant: Traffic Control Technology Co., Ltd, Beijing (CN)

(72) Inventors: Chao Liu, Beijing (CN); Qiang Zhang, Beijing (CN)

(73) Assignee: Traffic Control Technology Co., Ltd, Beijing (CN)

( * ) Notice: Subject to any disclaimer, the term of this patent is extended or adjusted under 35 U.S.C. 154(b) by 0 days.

(21) Appl. No.: 17/766,228

(22) PCT Filed: Dec. 25, 2019

(86) PCT No.: PCT/CN2019/128360
§ 371 (c)(1),
(2) Date: Apr. 2, 2022

(87) PCT Pub. No.: WO2021/082256
PCT Pub. Date: May 6, 2021

(65) Prior Publication Data

US 2024/0051587 A1 Feb. 15, 2024

(30) Foreign Application Priority Data

Oct. 29, 2019 (CN) ..... 201911038667.X

(51) Int. Cl.
*B61L 27/04* (2006.01)
*B61L 27/20* (2022.01)
*B61L 27/40* (2022.01)

(52) U.S. Cl.
CPC ..... *B61L 27/04* (2013.01); *B61L 27/20* (2022.01); *B61L 27/40* (2022.01); *B61L 2027/204* (2022.01)

(58) Field of Classification Search
CPC ..... B61L 25/02; B61L 27/04; B61L 27/20; B61L 27/40; B61L 2027/204
See application file for complete search history.

(56) References Cited

U.S. PATENT DOCUMENTS

2014/0346285 A1 11/2014 Carlson et al.
2019/0077427 A1* 3/2019 Itagaki ..... B61L 25/025
2020/0283007 A1* 9/2020 Choi ..... B60W 60/005

FOREIGN PATENT DOCUMENTS

CN 104354728 A 2/2015
CN 105480259 A 4/2016
(Continued)

OTHER PUBLICATIONS

PCT International Search Report for PCT/CN2019/128360, dated Jul. 23, 2020, 13 pages.
(Continued)

*Primary Examiner* — Peter D Nolan
*Assistant Examiner* — Ce Li Li
(74) *Attorney, Agent, or Firm* — East IP P.C.

(57) ABSTRACT

The present disclosure provides an automatic driving method, a VOBC, a TIAS, and a ZC. The method includes: sending, when a position of a target train is lost in a FAM mode and the target train is in an emergency-brake-stop state, a train message to a TIAS and fault information indicating loss of train position to a ZC, the train message including request information for a RRM mode; receiving a RRM mode instruction sent by the TIAS and a movement instruction sent by the ZC; and controlling the target train to travel in the RRM mode according to the RRM mode instruction and the movement instruction. With the technical
(Continued)

solutions provided in the present disclosure, operation efficiency of the train can be improved.

14 Claims, 3 Drawing Sheets

(56) References Cited

FOREIGN PATENT DOCUMENTS

| | | | | |
|---|---|---|---|---|
| CN | 107856703 | A | | 3/2018 |
| CN | 107 87 85 13 | A | | 4/2018 |
| CN | 108216308 | A | | 6/2018 |
| CN | 109664920 | A | | 4/2019 |
| CN | 109969232 | A | * | 10/2019 |
| CN | 110758485 | A | | 2/2020 |
| EP | 3461715 | A1 | | 4/2019 |

OTHER PUBLICATIONS

The First Office Action for Chinese Application No. 201911038667.X, dated Jun. 1, 2020, 17 pages.
The Second Office Action for Chinese Application No. 201911038667.X, dated Nov. 11, 2020, 14 pages.
The extended European search report for European Application No. 19951093.4, dated Jan. 15, 2024, 8 pages.

* cited by examiner

AUTOMATIC DRIVING METHODS, VEHICLE ON-BOARD CONTROLLERS, TRAFFIC CONTROL INTEGRATED AUTOMATION SYSTEMS, AND ZONE CONTROLLERS

CROSS-REFERENCE TO RELATED APPLICATION

This application is a National Stage of International Application No. PCT/CN2019/128360, filed on Dec. 25, 2019, which claims priority to Chinese Patent Application No. 201911038667.X, filed on Oct. 29, 2019, both of which are incorporated herein by reference in their entirety.

TECHNICAL FIELD

The present disclosure relates to the technical field of communication, and particularly to automatic driving methods, Vehicle on-board Controllers (VOBCs), Traffic Control Integrated Automation Systems (TIASs), and zone controllers.

BACKGROUND

With the development of rail transportation technology, fully automatic operation technology has been gradually adopted in construction of urban rail transportation.

During operation of a train, the train may fail to obtain position of the train in real time due to failure of a positioning module of a Vehicle on-board Controller (VOBC) or other reasons, and may not report correct position of the train to a Zone Controller (ZC), that is, the position of the train is lost.

At present, if the position of the train is lost, failure recovery may be quickly performed by the driver when the train is in a manual driving mode. During the operation of the train in an unattended Grade of Automation 4 (GoA4), there is no driver to supervise the operation in the train. When the position of the train is lost, the train cannot continue to travel, and the failure can be only recovered by a driver that is dispatched by a staff of an Operated Control Center (OCC) to get into the train. As a result, efficiency of train operation is low.

SUMMARY

The automatic driving method(s), device(s), medium(s), Vehicle on-board Controllers (VOBCs), Traffic Control Integrated Automation System (TIASs), Zone Controllers (ZCs) and RRM mode(s) provided by the embodiments of the present disclosure can improve the efficiency of train operation.

In a first aspect, an automatic driving method is provided and applied to a Grade of Automation 4 (GoA4) level driving scenario. The method includes: sending, when a position of a target train is lost in a Full Automatic Mode (FAM) mode and the target train is in an emergency-brake-stop state, a train message to a Traffic Control Integrated Automation System (TIAS) and fault information indicating loss of train position to a Zone Controller (ZC), the train message including request information for a Remote Restricted Train Operating Mode (RRM) mode; receiving a RRM mode instruction sent by the TIAS and a movement instruction sent by the ZC; and controlling the target train to travel in the RRM mode according to the RRM mode instruction and the movement instruction.

With the automatic driving method provided by the first aspect of the embodiments of the present disclosure, if the position of the train is lost during automatic operation of the train, the target train may be controlled to travel in the RRM mode under the control of the TIAS and the ZC. The train travelling in the RRM mode can continue to travel in the RRM mode, instead of stopping on a track, thus it will not affect normal operation of other trains, which can improve efficiency of train operation.

In an optional implementation, the RRM mode indicates that the target train, under remote control by the TIAS, is controlled to enter a front platform at a speed within a speed limit range.

With the automatic driving method provided by the implementation, the target train with the position lost may, under the remote control of the TIAS and the direct control of a Vehicle on-board Controller (VOBC), automatically enter the front platform at a speed without exceeding the speed limit range. As a result, the efficiency of train operation is guaranteed.

In an optional implementation, after controlling the target train to travel in the RRM mode, the method further includes: receiving a movement prohibition instruction sent by the ZC; and controlling, according to the movement prohibition instruction, the target train to perform an emergency brake to stop.

With the automatic driving method provided by the implementation, after controlling the target train to travel in the RRM mode, the travel of the train may also be controlled by the ZC sending the movement prohibition instruction. As a result, safety of the travel of the train in the RRM mode can be guaranteed.

In an optional implementation, after controlling the target train to travel in the RRM mode, the method further includes: determining that a switch condition for re-entering the FAM mode is satisfied, and switching an operation mode of the target train to the FAM mode.

With the automatic driving method provided by the implementation, if the train meets the condition for entering the FAM mode after the train has entered the RRM mode, the operation mode of the train can be directly switched to the FAM mode. The FAM mode corresponds to normal traveling of the train, thus normal operation of the train along the track can be guaranteed and the operation efficiency of the train can be improved.

In an optional implementation, the switch condition includes one or more of: the position of the train is reacquired, Movement Authority (MA) information sent by the ZC is received, authorization information for fully automatic driving sent by the TIAS is received, a preset driving mode with a highest automation level is the FAM mode, no communication failure is present in a Vehicle on-board Controller (VOBC), and the target train is released from the emergency-brake-stop state.

With the automatic driving method provided by the implementation, the switch condition may be refined into one or more of the above conditions, and it may be determined whether the switch condition for re-entering the FAM mode is satisfied from a plurality of different aspects. As a result, control efficiency and accuracy can be improved.

In an optional implementation, the train message further includes one or more of: a position identifier indicating that the position of the train is lost, direction information, activation end information, an operation mode prior to loss of position, a train operation level, state information indicating that the target train is in the emergency-brake-stop state, and a reason for emergency brake.

With the automatic driving method provided by the implementation, information on various aspects of the train can be reported to the TIAS, which facilitates control of the target train by the TIAS.

In a second aspect, an automatic driving method is provided and applied to a Grade of Automation 4 (GoA4) level driving scenario. The method includes: receiving a train message sent by a Vehicle on-board Controller (VOBC), the train message including request information for a Remote Restricted Train Operating Mode (RRM) mode; and sending, when a target train is in an unsupervised driving state and in response to a trigger instruction to enter the RRM mode, a RRM mode instruction to the VOBC for the VOBC controlling the target train to travel in the RRM mode according to the RRM mode instruction.

With the automatic driving method provided by the second aspect of the embodiments of the present disclosure, if the train message sent by the VOBC is received and the target train is in the unsupervised driving state, the RRM mode instruction is sent to the VOBC. The VOBC may control the target train to travel in the RRM mode based on the RRM mode instruction, instead of staying on the track. As a result, operation efficiency of the train can be improved.

In a third aspect, an automatic driving method is provided and applied to a Grade of Automation 4 (GoA4) level driving scenario. The method includes: receiving fault information indicating loss of a position of a target train sent by a Vehicle on-board Controller (VOBC); and sending, when the target train satisfies a movement condition, a movement instruction to the VOBC for the VOBC controlling the target train to travel in a Remote Restricted Train Operating Mode (RRM) mode according to the movement instruction.

With the automatic driving method provided by the third aspect of the embodiments of the present disclosure, if the fault information indicating the loss of the position of the target train sent by the VOBC is received and the target train satisfies the movement condition, the movement instruction is sent to the VOBC. The VOBC may control the target train to travel in the RRM mode according to the movement instruction, instead of staying on the track. As a result, operation efficiency of the train can be improved.

In an optional implementation, the movement condition includes one or more of: a route between the target train and a front platform is open, a section between the target train and the front platform is idle and locked, all turnouts between the target train and the front platform are locked, there are no other trains traveling between the target train and the front platform, there are no other faulty trains between the target train and the front platform, the front platform meets a pick-up condition, and a protection section outside a platform is locked and no other trains occupy the protection section.

With the automatic driving method provided by the implementation, whether the VOBC is allowed to move may be determined from states of route(s), turnout(s) and section(s). As a result, operation safety of train can be improved.

In an optional implementation, after the fault information indicating the loss of the position of the target train sent by the VOBC is received, the method further includes: calculating an automatic protection range; and calculating MA of other trains based on the automatic protection range, wherein, the automatic protection range indicates an estimated train stop range of the target train.

With the automatic driving method provided by the implementation, the automatic protection range may indicate an estimated train stop range of the target train. When the position of the target train is lost, although the position and the MA of the target train cannot be directly determined and other trains cannot be controlled based on the position and the MA of the target train, other trains can be controlled according to the automatic protection range so as to improve reliability of train scheduling.

In an optional implementation, when the position of the target train is lost and the target train is in an emergency-brake-stop state, the automatic protection range is a first automatic protection range, and the first automatic protection range is an overlapped part between an estimated range of the first automatic protection range, and a range indicated by the MA of the target train prior to loss of the position of the target train; and when the target train is in the RRM mode, the automatic protection range is between a largest position of the first automatic protection range and a position of the front platform, wherein the estimated range is determined based on an estimated train stop position.

With the automatic driving method provided by the implementation, when the train is in the emergency-brake-stop state, the automatic protection range of the train may be determined based on the estimated train stop position. When the train enters the RRM mode, a new safety envelop may be determined based on the MA prior to the loss of the position of the target train and the first automatic protection range. As the first automatic protection range indicates the position where the RRM mode is activated by the train, the automatic protection range of the train can be accurately calculated based on information such as operation state of the train.

In an optional implementation, after sending the movement instruction to the VOBC, the method further includes: monitoring section occupancy information in real time; and sending, when the section occupancy information includes information indicating a front section within the automatic protection range is occupied, a movement prohibition instruction to the VOBC, wherein the automatic protection range indicates the estimated train stop range of the target train.

With the automatic driving method provided by the implementation, the VOBC may be accurately controlled according to the section occupancy information. As a result, operation safety of train can be improved.

In a fourth aspect, a Vehicle on-board Controller (VOBC) is provided. The VOBC includes: a sending module to send, when a position of a target train is lost in a Full Automatic Mode (FAM) mode and the target train is in an emergency-brake-stop state, a train message to a Traffic Control Integrated Automation System (TIAS) and fault information indicating loss of train position to a Zone Controller (ZC), the train message including request information for a Remote Restricted Train Operating Mode (RRM) mode: a receiving module to receive a RRM mode instruction sent by the TIAS and a movement instruction sent by the ZC; and a control module to control the target train to travel in the RRM mode according to the RRM mode instruction and the movement instruction.

In a fifth aspect, a Traffic Control Integrated Automation System (TIAS) is provided. The TIAS includes: a receiving module to receive a train message sent by a Vehicle on-board Controller (VOBC), the train message including request information for a Remote Restricted Train Operating Mode (RRM) mode; and a sending module to send, when a target train is in an unsupervised driving state and in response to a trigger instruction to enter the RRM mode, a RRM mode instruction to the VOBC for the VOBC controlling the target train to travel in the RRM mode according to the RRM mode instruction.

In a sixth aspect, a Zone Controller (ZC) is provided. The ZC includes: a receiving module to receive fault information indicating loss of a position of a target train sent by a Vehicle on-board Controller (VOBC); and a sending module to send, when the target train satisfies a movement condition, a movement instruction to the VOBC for the VOBC controlling the target train to travel in a Remote Restricted Train Operating Mode (RRM) mode according to the movement instruction.

In a seventh aspect, an automatic driving device is provided. The device includes: a memory to store a program; and a processor to execute the program stored in the memory to perform the automatic driving methods provided by the first aspect, any optional implementation of the first aspect, the second aspect, any optional implementation of the second aspect, the third aspect, or any optional implementation of the third aspect.

In an eighth aspect, a computer storage medium is provided. The computer storage medium stores computer program instructions which, when executed by a processor, cause a machine to implement the automatic driving methods provided by the first aspect, any optional implementation of the first aspect, the second aspect, any optional implementation of the second aspect, the third aspect, or any optional implementation of the third aspect.

BRIEF DESCRIPTION OF THE DRAWINGS

In order to explain technical solutions of the embodiments of the present disclosure more clearly, drawings needed to be used in the embodiments of the present disclosure will be briefly introduced below. For an ordinary skilled person in the art, other drawings may be obtained from these drawings without creative efforts.

DETAILED DESCRIPTION

Figure 1:
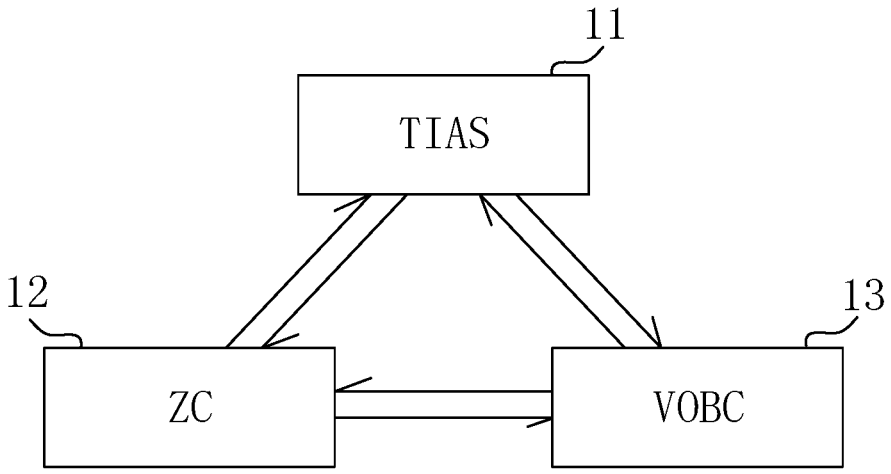
FIG. 1 is a system architecture diagram illustrating an automatic driving system according to an embodiment of the present disclosure.

The features and exemplary embodiments of various aspects of the present disclosure will be described in detail below. To make the objectives, technical solutions and advantages of the present application more apparent, the present application will be further described below in detail with reference to the drawings and embodiments. It should be understood that the specific embodiments described herein are only configured to explain the present application and are not configured to limit the present application. To those skilled in the art, the present application may be practiced without some of these specific details. The following description of the embodiments is merely intended to provide a better understanding of the present disclosure by illustrating examples of the present disclosure.

It should be noted that relational terms such as first, second and the like herein are only used to distinguish an entity or operation from another entity or operation, and do not require or imply these entities or operations have any such actual relationship or order. Moreover, the terms "comprise", "include" or any other variation thereof are intended to cover a non-exclusive inclusion, such that a process, a method, an article or a device that includes a series of elements includes not only those elements but also includes other elements that are not explicitly listed, or further includes elements inherent to such a process, method, article or device. In the case of no more limitation, the element defined by the phrase "include . . . " does not exclude that there are other same elements existing in the process, the method, the article or the device including the element.

According to levels of automation in train operation, there may be five driving levels: GoA0-GoA4. GoA4 level is the highest automation level in an urban rail transportation system. At the GoA4 level, control and driving of a train is performed by a system rather than staff.

At the GoA4 level, an automatic control system for a train in embodiments of the present disclosure may support a plurality of driving modes such as a Full Automatic Mode (FAM), a Creep Automatic Mode (CAM), an Automatic Mode (AM), a Restricted Train Operating Mode (RM), and the like.

In the FAM mode, operation of the train is completely controlled by a signal system. Under a normal operating condition, no driver operation is required. If the train operating in the FAM mode fails, the train is controlled to stop by emergency braking.

In order to improve operation efficiency of the train, an embodiment of the present disclosure provides a new operation mode for the train, that is, a Remote Restricted Train Operating Mode (RRM). In the GoA4 level driving scenario, after a train operating in the FAM mode is stopped by an emergency brake, the target train may be controlled by a Vehicle on-board Controller (VOBC) to enter a front platform with a speed within a speed limit range under remote control of a Traffic Control Integrated Automation System (TIAS). The maximum speed limit in the speed limit range may be 25 kmph. In other words, the VOBC may control the target train to travel to the next platform on its driving lane at a speed no higher than 25 kmph.

In order to better understand the present disclosure, the method(s), device(s), equipment(s), and medium(s) for automatic driving according to the embodiments of the present disclosure will be described in detail below with reference to the accompanying drawings. It should be noted that these embodiments are not intended to limit the scope of the present disclosure.

FIG. 1 is a system architecture diagram illustrating an automatic driving system according to an embodiment of the present disclosure. The automatic driving system in the embodiments of the present disclosure may be a Communication Based Train Control (CBTC) system. As shown in FIG. 1, the automatic driving system may include a TIAS 11, a Zone Controller (ZC) 12, and a VOBC 13, which may communicate with each other.

The TIAS 11 is a core subsystem of the CBTC system and capable of various functions such as controlling of travel, monitoring of all trains, monitoring of locomotive equipment, monitoring of electrical equipment, and the like.

The ZC 12 is a core ground control device in the CBTC system and a hub for ground-car information interaction. It is mainly responsible for calculating and generating Movement Authorization (MA) for communication trains within its control range, based on the position information reported by the communication trains and the track occupancy/free information provided by the interlocked routes and trackside equipment, so as to guarantee safe operation of the communication trains within its control range. The MA is used to maintain a safe train interval. The MA is a specific track section where a train is authorized to enter and pass according to a given travel direction. The start of the MA may be a tail of the train, and the end of the MA may be a tail of an automatic protection (AP) range of a front train, a turnout, the end of the route, a ZC boundary, the end of the track, a boundary of a buffer zone, and so on.

The VOBC 13 is responsible for supervision and direct control of trains, over-speed protection of trains, automatic driving of trains, human-computer interaction, and the like. The VOBC may include an Automatic Train Protection (ATP) system, an Automatic Train Operation (ATO) system, a Man Machine Interface (MMI) system, a Record System On Vehicle, RSOV), a speed positioning system (a speed sensor, a radar, a Balise Transmission Module (BTM), etc.), a Data Communication System (DCS), etc.

During the normal operation of the train in the FAM mode, the VOBC may report the real-time position of the train to the ZC. The ZC may calculate the MA based on the real-time position of the train, and report the calculated MA and the real-time position of the train to the TIAS. The TIAS may display the current position of the train in real time for driving control and monitoring of all trains.

Figure 2:
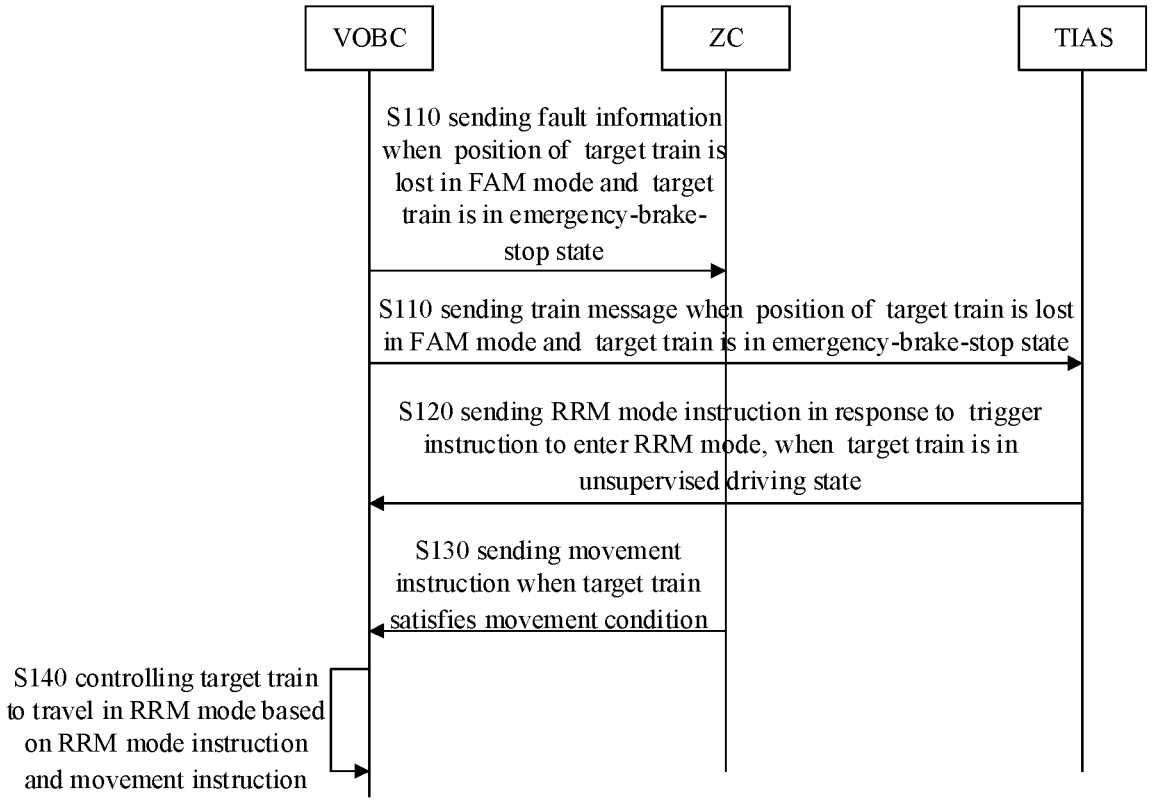
FIG. 2 is a schematic diagram illustrating an interaction flow of an automatic driving method according to an embodiment of the present disclosure.

FIG. 2 is a schematic diagram illustrating an interaction flow of an automatic driving method according to an embodiment of the present disclosure. As shown in FIG. 2, the automatic driving method 200 in the embodiments may be applied to a GoA4 level driving scenario.

The automatic driving method 200 may include step S110 where the VOBC sends, when a position of a target train is lost in the FAM mode and the target train is in an emergency-brake-stop state, a train message to the TIAS and fault information indicating loss of train position to the ZC. It should be noted that, for convenience of description, in the following part of the embodiments of the present disclosure, the VOBC refers to the VOBC of the target train, and the ZC refers to the ZC in which the target train is within its control range.

In S110, the loss of train position indicates that VOBC was unable to obtain the real-time position of the train. In the FAM mode, the train position may be lost due to a failure of a positioning module in the VOBC, a failure of a ground transponder, and other reasons. The failure of the positioning module of the VOBC may be a failure of a Balise Transmission Module (BTM). For example, it may be a failure in a responder antenna.

For the target train operating in FAM mode, if the position of the train is found to be lost, an emergency brake will be performed first to control the train to stop. After the train is stopped, in order not to affect the operation of other trains, the VOBC of the target train will request to enter the RRM mode to fully and safely control the target train to enter the front platform.

In order to safely control the target train to enter the front platform, the VOBC of the target train needs to request the TIAS and the ZC to jointly determine whether the target train is allowed to enter the RRM mode and assist in controlling the target train to travel to the front platform in the RRM mode. Therefore, in S110, after the train is in the emergency-brake-stop state, the VOBC of the target train may send a train message to the TIAS to inform the TIAS of the loss of the position of the target train and request to enter the RRM mode. The train message may include request information for the RRM mode, and the request information for the RRM mode may be used to request the TIAS to allow the target train to enter the RRM mode. Moreover, the VOBC of the target train may send fault information indicating loss of train position to the ZC to inform the ZC of the loss of the position of the target train and request the ZC to assist in determining whether the target train is allowed to enter the RRM mode.

In an embodiment, the train message may further include one or more of the following information A to information G.

Information A: a position identifier indicating that the position of the train is lost. Specifically, when the train position is not lost, a bit(s) for the position identifier may be train-specific position information. After the train position is lost, the bit(s) for the position identifier may use a predefined character string to indicate that the train position is lost, such as "0000", "FFFF", etc., which is not limited.

Information B: direction information. Specifically, after the train position is lost, the last acquired direction may be used as current direction information of the train.

Information C: activation end information. There is a driver's cab at each end of the train. When one of the driver's cabs is activated, the activated driver's cab is called the active end.

Information D: an operation mode prior to loss of position. For example, the train is operated in the FAM mode before the position is lost in the embodiments of the present disclosure, thus a specific format of the operation mode prior to loss of position may be "CBTC-FAM". The embodiments of the present disclosure do not limit the specific format of the operation mode prior to loss of position.

Message E: a train operation level. Specifically, in order of level from high to low, train operation levels may include: CBTC level (i.e., the operation level of ATP/ATO under infinite continuous communication control), BLOC level (i.e., the operation level of ATP/ATO under point control), IL level (i.e., the operation level under an interlock level). In the embodiments of the present disclosure, the train operation level is the CBTC level.

Information F: state information indicating that the target train is in the emergency-brake-stop state.

Information G: a reason for emergency brake. Specifically, the reason for the emergency braking of the train in the embodiments of the present disclosure is specifically that the train position is lost.

The above information A to information G may assist the TIAS to accurately determine whether the target train is allowed to enter the RRM mode. In addition, the above information A to information G may also inform the TIAS of the train message of the target train, so that the TIAS may direct and dispatch the target train according to the train message.

The automatic driving method 200 may include step S120 where the TIAS receives the train message sent by the VOBC. If the target train is in an unsupervised driving state, the TIAS may send a RRM mode instruction to the VOBC in response to a trigger instruction to enter the RRM mode. The trigger instruction may be initiated by an operator of the TIAS, or a related control module. Specifically, the operator of the TIAS may click a corresponding trigger control on a human-computer interaction interface of the TIAS to send the trigger instruction to the TIAS.

In S120, if the TIAS responds to the trigger instruction to enter the RRM mode, the TIAS determines that the VOBC is allowed to enter the RRM mode, and sends the RRM mode instruction to the VOBC. The RRM mode instruction may indicate that the VOBC is allowed to enter the RRM mode.

In some embodiments, after the TIAS receives the train message sent by the VOBC, the human-computer interaction interface of the TIAS may pop up a window to display the train message to remind the operator of the TIAS to perform a state management operation according to the train message. In addition, in order to assist TIAS to control the target train, the human-computer interaction interface of TIAS can also display the active end information of the target train. The activation end information may indicate which of the cabs at both ends of the target train the activation end is.

In some embodiments, after receiving the train message sent by the VOBC, the TIAS also needs to determine whether the target train is in the unsupervised driving state. The operator of the TIAS or a related determination module may determine whether the target train is in the unsupervised driving state, based on a determination of whether there being a driver on board and whether the target train being necessary to wait for the driver to board the train for rescue. If there is no driver on board or the target train does not need to wait for the driver to board the train for rescue, it is determined that the target train is in the unsupervised driving state. Specifically, it may be determined whether the driver is on board based on information such as duty schedule for the driver, an image acquisition device in the driver's cab, a dedicated communication device in the driver's cab for communication with the TIAS center, and the like. It may be determined whether the driver is needed to board the train for rescue based on a determination of whether the train having other failure causes other than the loss of position. For example, if the target train still has a heavy brake failure, it is determined that it is necessary to wait for the driver to board the train to rescue.

In addition, the case that the target train may be in a supervised driving state may also be considered. For example, if the driver is on board or the target train has to wait for the driver to board the train for rescue, the driver may control the target train to travel. At this time, the TIAS will not remotely control the target train, which means that the TIAS will not send the RRM mode instruction to the VOBC. Optionally, if it is determined that the target train is in the supervised driving state, the driver may perform manual control operations such as starting the train with a key or pressing a control button.

The automatic driving method 200 may include step S130 where the ZC receives the fault information sent by the VOBC. If the target train meets a movement condition, the ZC may send a movement instruction to the VOBC.

The movement condition may be used to measure whether the train meets criteria for moving into the front platform. The movement instruction may indicate that the ZC determines that driving environment of the target train is safe in the RRM mode and the ZC allows the target train to enter the RRM mode. It may be determined whether the target train satisfies the movement condition based on a section where the target train is located. Specifically, the movement condition may include one or more of the following movement sub-condition A to movement sub-condition G.

Movement sub-condition A: a route between the target train and the front platform is open. The front platform refers to a stoppable platform that is closest to the target train. The route refers to a path(s) via which the target train travels to enter the front platform. The front platform may determine, based on the section where the target train is located, that the section where the target train is located is the section where the target train was located prior to loss of the position of the target train.

If the route is open, it means that the target train can be allowed to enter the route. Specifically, if the route includes one or more sections, it can be determined whether each section is open based on a state of a signal machine at the beginning of each section. If the signal machine at the beginning of an individual section is in an enable state, for example, the signal machine at the beginning of the individual section emits a light indicating the enable state, it is indicated that the section is open.

Movement sub-condition B: a section between the target train and the front platform is idle and locked. If it is determined that the section between the target train and the front platform is idle and locked, it means that there are no other trains between the target train and the front platform.

Specifically, whether the segment is idle may be determined by an axle counting device. If a front section is idle, it means that there are no trains in the front section.

A locked section may indicate that if a turnout section within the section is occupied by a train, the turnout in the turnout section cannot be switched.

Movement sub-condition C: all turnouts between the target train and the front platform are locked. Specifically, if a turnout is locked, it may indicates that the turnout must be locked in a predetermined position and cannot be switched.

Movement sub-condition D: there are no other trains traveling between the target train and the front platform.

Movement sub-condition E: there are no other faulty trains between the target train and the front platform.

Movement sub-condition F: the front platform meets a pick-up condition. If the front platform meets the pick-up condition, it may indicate that the section to the front platform is idle, and the pick-up route has been prepared to allow the train to enter the front platform. For example, the pick-up condition may include the pick-up line being idle, the position of the turnout of the route being correct, shunting operation that affects the route being stopped, and the like.

Movement sub-condition G: a protection section outside a platform is locked and no other trains occupy the protection section. The protection section outside a platform refers to a repetitive zone set up to prevent dangerous consequences caused by violation of a signal rule by the train.

In addition, if the target train does not meet the movement condition, the VOBC may control the target train to maintain the emergency-brake-stop state and wait for the operator to board the train for rescue. Optionally, the VOBC may send a prompt message to the TIAS indicating that the target train does not have the ability to enter the RRM mode, so that the TIAS may notify relevant operators to board the train for rescue.

It should be noted that, in the embodiments of the present disclosure, S120 may be performed before S130, S120 and S130 may be performed simultaneously, or S120 may be performed after S130, that is, specific order of performance between S120 and S130 is not limited.

The automatic driving method 200 may include step S140 where the VOBC receives an RRM mode instruction sent by the TIAS and the movement instruction sent by the ZC. The VOBC may control the target train to travel in the RRM mode based on the RRM mode instruction and the movement instruction.

In S140, if the VOBC receives the RRM mode instruction and the movement instruction, it is determined that both the TIAS and the ZC allow the target train to operate in the RRM mode, and the driving environment of the target train in the RRM mode is safe. Therefore, the VOBC may control the target train to travel in the RRM mode, that is, in the RRM mode, the VOBC may control the start, idle and stop of the target train by issuing a traction instruction or a braking instruction to the target train.

In some embodiments of the present disclosure, after the ZC receives the fault information, the automatic driving method 200 may further include step S151 and step S152.

In S151, an automatic protection range is calculated. The automatic protection range may indicate that an estimated train stop range of the target train. During traveling of the target train, it should be determined that there are no other trains within the automatic protection range of the target train.

Specifically; the automatic protection range is related to the operation state of the target train. Below, the automatic protection range will be specifically described with respect to two situations of the target train.

In the first case, if the position of the target train is lost and the target train is in the emergency-brake-stop state, the automatic protection range may be referred to as a first automatic protection range $[A_1, B_1]$. The first automatic protection range $[A_1, B_1]$ does not exceed the range of the section where the target train is located. That is to say, after calculating the estimated range $[a_1, b_1]$ of the first automatic protection range, it is necessary to use the MA $[a_0, b_0]$ of the target train prior to loss of position to determine the first automatic protection range again. The MA is the last MA generated by the ZC before the loss of the position of the target train position occurred.

The first automatic protection range is an overlapped part between the estimated range of the first automatic protection range, and a range indicated by the MA of the target train prior to loss of the position of the target train. Specifically, the maximum position $B_1$ of the first automatic protection range is the smaller one between the maximum position $b_1$ of the estimated range of the first automatic protection range, and position $b_0$ of the MA prior to loss of the position of the target train. The minimum position $A_1$ of the first automatic protection range is the greater one between the minimum position $a_1$ of the estimated range, and position $a_0$ of the MA prior to loss of the position of the target train.

Optionally; the estimated range $[a_1, b_1]$ of the first automatic protection range may be determined based on an estimated train stop position. The tail of the target train may be determined as the minimum position $a_1$ of the automatic protection range. The estimated train stop position of the head of the target train is taken as the maximum position $b_1$ of the automatic protection range. Specifically, the estimated train stop position may be the position of the head of the target train plus the maximum travel distance L of the target train before the emergency stop.

In an example, in order to accurately obtain the estimated train stop position of the target train, an equation to calculate the maximum travel distance L is shown in Equation (1):

$$L=L_1+L_2 \tag{1}$$

The maximum travel distance of the target train during the loss of position $L_1$ satisfies Equation (2):

$$L_1=V_0*T+\tfrac{1}{2}a_1*T^2 \tag{2}$$

$V_0$ is the traveling speed of the target train when the VOBC last reported position information. $a_1$ in Equations is the maximum acceleration in the traction state, and $a_1$ is a positive value. The time difference T is the difference between the time instance when the information on loss of train position is received and the current time instance. In other words, after the train position is lost, the target train travels normally within T seconds, and an emergency brake is applied after the T seconds.

The maximum emergency brake distance during the emergency brake $L_2$ satisfies Equation (3):

$$L_2=V(T)*V(T)/(2*a_2) \tag{3}$$

$a_2$ in Equations is the maximum acceleration in the emergency-brake-stop state, and $a_2$ is a negative value. V(T) is the traveling speed of the train after the train position is lost for T seconds. V(T) satisfies Equation (4):

$$V(T)=V_1+a_1*T \tag{4}$$

The target train will not immediately perform an emergency brake to stop after the position of the train is lost. Instead, it will normally travel for T seconds, and then stop immediately after determining that the position is lost. In the embodiments of the present disclosure, the maximum travel distance L may be calculated with the maximum travel distance of the target train during the loss of position $L_1$ and the maximum emergency brake distance during the emergency brake $L_2$. When calculating the travel distance of the target train during the loss of position $L_1$, in order to obtain the maximum $L_1$, the maximum acceleration in the traction state may be used to calculate $L_1$. When calculating the maximum emergency brake distance during the emergency brake $L_2$, the maximum acceleration in the traction state may be used to calculate $L_2$ to obtain the maximum $L_2$. Therefore, the accuracy of the calculated maximum travel distance L can be guaranteed.

It should be noted that the larger position and the smaller position in the embodiments of the present disclosure are described with respect to the target train. In the movement direction of the train, the position closest to the target train is referred to as the minimum position, and the position farthest from the target train is referred to as the maximum position.

In the second case, if the target train is in the RRM mode, the automatic protection range is the range between the maximum position $B_1$ of the first automatic protection range and the position $C_1$ of the front platform.

In S152, MA(s) of other trains can be calculated based on the automatic protection range.

In addition, the ZC may also send the automatic protection range to the TIAS, and display it to the operator through the human-computer interaction system to facilitate adjustment of the operation plan.

In some embodiments of the present disclosure, during travel of the target train in the RRM mode, in order to ensure safety travel of the train, after S140, the automatic driving method 200 may further include steps S161, S162, and S163.

In S161, the ZC monitors segment occupancy information in real time. The ZC may monitor occupancy information of all sections within its control range. The section occupancy information may include information indicating that a section is idle or occupied.

In S162, if the segment occupancy information includes information indicating that a front section within the automatic protection range is occupied, the ZC sends a movement prohibition instruction to the VOBC. The movement prohibition instruction may indicate that ZC does not allow the target train to enter the RRM mode.

After the train enters the RRM mode, the automatic protection range is the range between the maximum position of the first automatic protection range and the position of the front platform. Therefore, the front section within the automatic protection range refers to one or more adjacent sections immediately next to the front platform and in front of the section where the target train is currently located.

If the front section within the automatic protection range is occupied, it is indicated that there is an obstacle between the target train and the front platform, and the target train cannot safely enter the front platform in the RRM mode. In order to improve the operation safety of the target train, the ZC may send a movement prohibition instruction to the VOBC.

In S163, the VOBC receives the movement prohibition instruction sent by the ZC, and controls the target train to perform an emergency brake to stop according to the movement prohibition instruction.

In some embodiments of the present disclosure, during travel of the target train in the RRM mode, when the failure of loss of train position is recovered, the target train may be controlled to automatically return to the normal operation in order to improve the operation efficiency of the train. After S140, the automatic driving method 200 may further include S170 where the VOBC determines that a switch condition for re-entering the FAM mode is satisfied, and switches the operation mode of the target train to the FAM mode. With S170, when the VOBC may determine that the switch condition for re-entering the FAM mode is satisfied, it is determined that the failure of loss of the position of the target train is repaired or automatically restored, and the target train satisfies the condition for re-entering the FAM mode. Therefore, under the control of the VOBC, the operation mode of the target train may be switched to the FAM mode. Specifically, under the control of the VOBC, the target train may be switched from the RRM mode to the FAM mode without stopping.

The switch condition may include one or more of switch sub-conditions A-F.

Switch sub-condition A: the position of the train is reacquired. If the real-time position of the target train is re-monitored by the VOBC, it is indicated that the position of the target train is obtained again.

Switch sub-condition B: MA information sent by the ZC is received. If the VOBC reacquires the real-time position of the train, it may send the real-time position of the target train to the ZC. The ZC may calculate the MA of the target train based on the real-time position, and send the MA of the target train to the VOBC. During the loss of train position, the ZC cannot calculate the MA as it cannot obtain the real-time position of the target train.

Switch sub-condition C: authorization information for fully automatic driving sent by the TIAS is received. After the VOBC requests from TIAS to enter the FAM mode, if the TIAM allows the VOBC to enter the FAM mode, the authorization information may include response information that allows the VOBC to enter the FAM mode.

Switch sub-condition D: a preset driving mode with a highest automation level is the FAM mode. The driving mode with a highest automation level may be preset during the automatic driving. After the driving mode with a highest automation level is set, the automation level during the operation of the train will not be higher than the preset driving mode with a highest automation level. For example, if the driving mode with a highest automation level is the RRM mode, since the automation level of the FAM mode is higher than that of the RRM mode, the train will not switch to the FAM mode. Therefore, if the operation mode of the train is desired to be switched from the RRM mode to the FAM mode, the driving mode with a highest automation level should be the FAM mode.

Switch sub-condition E: no failure is present in internal communication of the VOBC. The VOBC may internally include ATP, ATO, speed sensor, radar, BTM, etc. If it is required to switch to the FAM mode, the various modules inside the VOBC should operate normally.

Switch sub-condition F: the target train is released from the emergency-brake-stop state. An implementation for determining that the target train has released from the emergency-brake-stop state may include: determining that an ATP direction handle is at zero position and a traction brake handle is at zero position before cab activation is outputted. Specifically, the position information of the traction brake handle and the ATP direction handle may be obtained from corresponding network interfaces.

Devices according to the embodiments of the present disclosure will be described in detail below with reference to the accompanying drawings.

Figure 3:
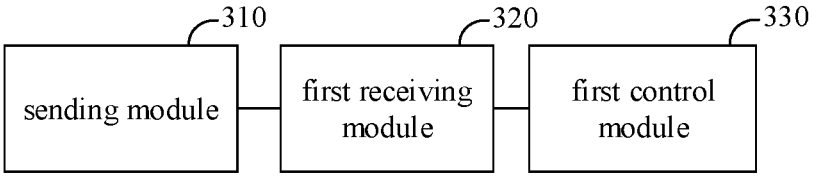
FIG. 3 illustrates a schematic structural diagram of a VOBC according to an embodiment of the present disclosure.

Based on the same inventive concept, a VOBC is provided in an embodiment of the present disclosure. FIG. 3 illustrates a schematic structural diagram of a VOBC according to an embodiment of the present disclosure. As shown in FIG. 3, the VOBC 13 may include a sending module 310, a first receiving module 320, and a first control module 330.

The sending module 310 may be configured to send, when the position of the target train is lost in the FAM mode and the target train is in the emergency-brake-stop state, a train message to the TIAS and fault information indicating loss of train position to the ZC. The train message may include request information for the RRM mode.

The first receiving module 320 may be configured to receive the RRM mode instruction sent by the TIAS and the movement instruction sent by the ZC.

The first control module 330 may be configured to control the target train to travel in the RRM mode according to the RRM mode instruction and the movement instruction.

In some embodiments of the present disclosure, the RRM mode may indicate that the VOBC may control the target train to enter the front platform at a speed within the speed limit range in a GoA4 level driving scenario, under remote control of the TIAS.

In some embodiments of the present disclosure, the VOBC 13 may further include a second receiving module and a second control module.

The second receiving module may be configured to receive the movement prohibition instruction sent by the ZC.

The second control module may be configured to control the target train to perform an emergency brake to stop according to the movement prohibition instruction.

In some embodiments of the present disclosure, the VOBC 13 may further include a switch module configured to determine that the switch condition for re-entering the FAM mode is satisfied, and switch the operation mode of the target train to the FAM mode.

In some embodiments of the present disclosure, the switch condition may include one or more of: the position of the train is reacquired, MA information sent by the ZC is received, authorization information for fully automatic driving sent by the TIAS is received, the driving mode with a highest automation level is the FAM mode, no failure is present in internal communication of the VOBC, and the target train is released from the emergency-brake-stop state.

In some embodiments of the present disclosure, the train message may further include one or more of: the position identifier indicating that the position of the train is lost, direction information, activation end information, the operation mode prior to loss of position, the train operation level, state information indicating that the target train is in the emergency-brake-stop state, and the reason for emergency brake.

Other details of the VOBC according to the embodiments of the present disclosure are similar to the methods according to the embodiments of the present disclosure described above in conjunction with FIG. 1, and details are not described herein again.

Figure 4:
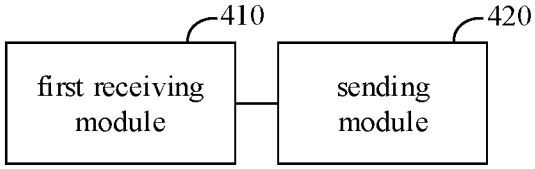
FIG. 4 illustrates a schematic structural diagram of a TIAS according to an embodiment of the present disclosure.

Based on the same inventive concept, a TIAS is provided in the embodiments of the present disclosure. FIG. 4 illustrates a schematic structural diagram of a TIAS according to an embodiment of the present disclosure. As shown in FIG. 4, the TIAS 11 may include a first receiving module 410 and a sending module 420.

The first receiving module 410 may be configured to receive the train message sent by the VOBC. The train message may include the request information for the RRM mode.

The sending module 420 may be configured to send, when the target train is in the unsupervised driving state and in response to the trigger instruction to enter the RRM mode, the RRM mode instruction to the VOBC.

Other details of the TIAS according to the embodiments of the present disclosure are similar to the methods according to the embodiments of the present disclosure described above in conjunction with FIG. 1, and details are not described herein again.

Figure 5:
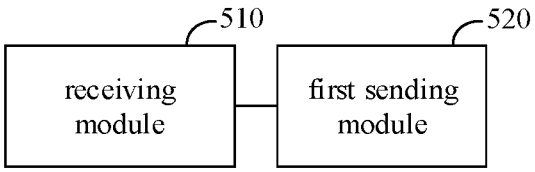
FIG. 5 illustrates a schematic structural diagram of a ZC according to an embodiment of the present disclosure.

Based on the same inventive concept, a ZC is provided in the embodiments of the present disclosure. FIG. 5 illustrates a schematic structural diagram of a ZC according to an embodiment of the present disclosure. As shown in FIG. 5, the ZC 12 may include a receiving module 510 and a first sending module 520.

The receiving module 510 may be configured to receive the fault information indicating loss of position of the target train sent by the VOBC.

The first sending module 520 may be configured to send the movement instruction to the VOBC when the target train meets the movement condition.

In some embodiments of the present disclosure, the movement condition may include one or more of: a route between the target train and the front platform is open, a section between the target train and the front platform is idle and locked, all turnouts between the target train and the front platform are locked, there are no other trains traveling between the target train and the front platform, there are no other faulty trains between the target train and the front platform, the front platform meets a pick-up condition, and a protection section outside a platform is locked and no other trains occupy the protection section.

In some embodiments of the present disclosure, the ZC 12 may further include a calculation module and a control module.

The calculation module may be configured to calculate the automatic protection range. The automatic protection range may indicate the minimum safe distance range between the target train and the front train.

The control module may be configured to calculate MA(s) of other train(s) based on the automatic protection range.

In some embodiments of the present disclosure, if the position of the target train is lost and the target train is in the emergency-brake-stop state, the automatic protection range is a first automatic protection range, and the first automatic protection range is an overlapped part between an estimated range of the first automatic protection range, and a range indicated by the MA of the target train prior to loss of the position of the target train; and if the target train is in the RRM mode, the automatic protection range is between a largest position of the first automatic protection range and a position of the front platform. The estimated range is determined based on an estimated train stop position.

In some embodiments of the present disclosure, the ZC 12 may further include a monitoring module and a third sending module.

The monitoring module may be configured to monitor section occupancy information in real time.

The third sending module may be configured to send, when the section occupancy information includes information indicating a front section within the automatic protection range is occupied, a movement prohibition instruction to the VOBC. The automatic protection range indicates an estimated train stop range of the target train.

Other details of the ZC according to the embodiments of the present disclosure are similar to the methods according to the embodiments of the present disclosure described above in conjunction with FIG. 1, and details are not described herein again.

Figure 6:
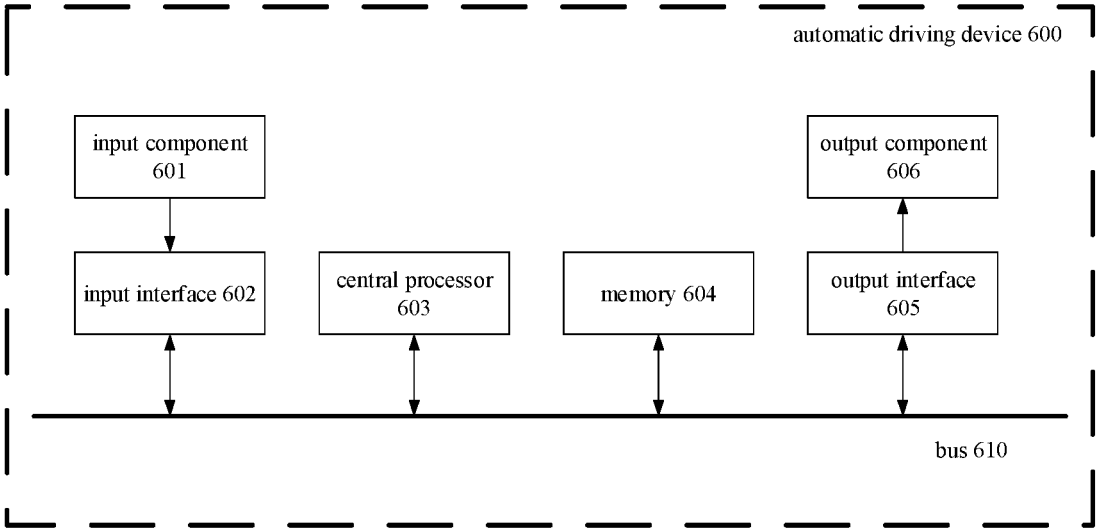
FIG. 6 is a structural diagram of an exemplary hardware architecture of an automatic driving device in an embodiment of the present disclosure.

FIG. 6 is a structural diagram of an exemplary hardware architecture of an automatic driving device in an embodiment of the present disclosure.

As shown in FIG. 6, the automatic driving device 600 includes an input component 601, an input interface 602, a central processor 603, a memory 604, an output interface 605, and an output component 606. The input interface 602, the central processor 603, the memory 604, and the output interface 605 are connected to each other through a bus 610. The input component 601 and the output component 606 are connected to the bus 610 through an input interface 602 and an output interface 605, respectively; and in turn connected to other components of the automatic driving device 600.

Specifically, the input component 601 may receive input information from the outside and transmit the input information to the central processor 603 through the input interface 602. The central processor 603 may process the input information based on computer-executable instructions stored in the memory 604 to generate output information, temporarily or permanently store the output information in the memory 604, and then transmit the output information to the output component 606 through the output interface 605. The output component 606 may output the output information to the outside of the automatic driving device 600 for use by a user.

That is, the automatic driving device shown in FIG. 6 may also be implemented to include: a memory to store computer-executable instructions; and a processor to implement, when executing the computer-executable instructions, the automatic driving system, the automatic driving method, the VOBC, the TIAS and the ZC in combination with FIG. 1 to FIG. 5.

In an embodiment, the automatic driving device 600 shown in FIG. 6 may be implemented as apparatus including a memory to store computer-executable instructions, and a processor to execute the computer-executable instructions stored in the memory to implement the automatic driving system, the automatic driving method, the VOBC, the TIAS and the ZC in combination with FIG. 1 to FIG. 5.

An embodiment of the present disclosure also provides a computer storage medium. The computer storage medium stores computer program instructions which, when executed by a processor, cause to implement the automatic driving system, the automatic driving method, the VOBC, the TIAS and the ZC in combination with FIG. 1 to FIG. 5.

It should be understood that the present application is not limited to the specific configurations and processes described above and shown in the figures. For the sake of conciseness, a detailed description of known methods is omitted here. In the above described embodiments, several specific steps have been described and illustrated as examples. However, the process in the present disclosure is not limited to the described and illustrated specific steps, and those skilled in the art can make various changes, modifications, and additions or change the order between steps after understanding the spirit of the present disclosure.

The functional blocks shown in the block diagrams described above may be implemented as hardware, software, firmware, or a combination thereof. When implemented in hardware, it may be, for example, an electronic circuit, an application specific integrated circuit (ASIC), a suitable firmware, a plug-in, a function card, and the like. When implemented in software, the elements of the present disclosure are programs or code segments that are used to perform the required tasks. The programs or code segments may be stored on a machine-readable medium or transmitted over a transmission medium or communication link via a data signal carried in a carrier wave. The "machine-readable medium" may include any medium that is capable of storing or transmitting information. Examples of machine-readable media include an electronic circuitry, a semiconductor memory device, a ROM, a flash memory, an erasable ROM (EROM), a floppy disk, a CD-ROM, an optical disk, a hard disks, fiber optic media, a radio frequency (RF) link, and the like. The code segments may be downloaded via a computer network such as the Internet, an intranet or the like.

The foregoing descriptions are merely specific implementations of the present disclosure. Those skilled in the art can clearly understand that, for the convenience and conciseness of the description, the specific working processes of the above-described systems, modules and units may refer to the foregoing method embodiments. The corresponding process in this article is not described here.

What is claimed is:

1. An automatic driving method applied to a Grade of Automation 4 (GoA4) level driving scenario, the method comprising:

sending, when a position of a target train is lost in a Full Automatic Mode (FAM) mode and the target train is in an emergency-brake-stop state, a train message to a Traffic Control Integrated Automation System (TIAS) and fault information indicating loss of train position to a Zone Controller (ZC), the train message including request information for a Remote Restricted Train Operating Mode (RRM) mode;

receiving a RRM mode instruction sent by the TIAS and a movement instruction sent by the ZC; and controlling the target train to travel in the RRM mode according to the RRM mode instruction and the movement instruction, receiving a movement prohibition instruction which is sent by the ZC if segment occupancy information includes information indicating that a front section within an automatic protection range is occupied, wherein when the position of the target train is lost and the target train is in the emergency-brake-stop state, the automatic protection range is a first automatic protection range, and the first automatic protection range is an overlapped part between an estimated range of the first automatic protection range and a range indicated by Movement Authority (MA) of the target train prior to loss of the position of the target train, the estimated range being determined based on an estimated train stop position; and when the target train is in the RRM mode, the automatic protection range is between a largest position of the first automatic protection range and a position of a front platform, controlling, according to the movement prohibition instruction, the target train to perform an emergency brake to stop.

2. The method of claim 1, wherein the RRM mode indicates that the target train, under remote control by the TIAS, is controlled to enter the front platform at a speed within a speed limit range.

3. The method of claim 1, wherein after controlling the target train to travel in the RRM mode, the method further comprises:

determining that a switch condition for re-entering the FAM mode is satisfied, and switching an operation mode of the target train to the FAM mode.

4. The method of claim 3, wherein the switch condition includes one or more of:

the position of the target train is reacquired, Movement Authority (MA) information sent by the ZC is received, authorization information for fully automatic driving sent by the TIAS is received, a preset driving mode with a highest automation level is the FAM mode, no communication failure is present in a Vehicle on-board Controller (VOBC), and the target train is released from the emergency-brake-stop state.

5. The method of claim 1, wherein the train message further includes one or more of:

a position identifier indicating that the position of the train is lost, direction information, activation end information, an operation mode prior to loss of position, a train operation level, state information indicating that the target train is in the emergency-brake-stop state, and a reason for emergency brake.

6. An automatic driving method applied to a Grade of Automation 4 (GoA4) level driving scenario, the method comprising:

receiving fault information indicating loss of a position of a target train sent by a Vehicle on-board Controller (VOBC); and sending, when the target train satisfies a movement condition, a movement instruction to the VOBC for the VOBC controlling the target train to travel in a Remote Restricted Train Operating Mode (RRM) mode according to the movement instruction, wherein after receiving the fault information indicating the loss of the position of the target train sent by the VOBC, the method further comprises:

calculating an automatic protection range, wherein the automatic protection range indicates an estimated train stop range of the target train, wherein:

when the position of the target train is lost and the target train is in an emergency-brake-stop state, the automatic protection range is a first automatic protection range, and the first automatic protection range is an overlapped part between an estimated range of the first automatic protection range and a range indicated by Movement Authority (MA) of the target train prior to loss of the position of the target train; and when the target train is in the RRM mode, the automatic protection range is between a largest position of the first automatic protection range and a position of the front platform, wherein the estimated range is determined based on an estimated train stop position, wherein the estimated train stop position is determined based on a position of a head of the target train plus a maximum travel distance of the target train before the emergency-brake-stop, and wherein the MA is a specific track section where the target train is authorized to enter and pass according to a given travel direction, a start of the MA is a tail of the target train, and an end of the MA is a tail of an automatic protection (AP) range of a front train, a turnout, an end of a route, a ZC boundary, an end of a track, a boundary of a buffer zone.

7. The method of claim 6, wherein the movement condition includes one or more of:

a route between the target train and a front platform is open, a section between the target train and the front platform is idle and locked, all turnouts between the target train and the front platform are locked, there are no other trains traveling between the target train and the front platform, there are no other faulty trains between the target train and the front platform, the front platform meets a pick-up condition, and a protection section outside a platform is locked and no other trains occupy the protection section.

8. The method of claim 6, wherein after receiving the fault information indicating the loss of the position of the target train sent by the VOBC, the method further comprises:

calculating Movement Authority (MA) of other trains based on the automatic protection range.

9. The method of claim 6, wherein after sending the movement instruction to the VOBC, the method further comprises:

monitoring section occupancy information in real time; and sending, when the section occupancy information includes information indicating a front section within the automatic protection range is occupied, a movement prohibition instruction to the VOBC.

10. An automatic driving device, comprising:

a memory to store a program; and a processor to execute the program stored in the memory, wherein the processor is to:

send, when a position of a target train is lost in a Full Automatic Mode (FAM) mode and the target train is in an emergency-brake-stop state, a train message to a Traffic Control Integrated Automation System (TIAS) and fault information indicating loss of train position to a Zone Controller (ZC), the train message including request information for a Remote Restricted Train Operating Mode (RRM) mode;

receive a RRM mode instruction sent by the TIAS and a movement instruction sent by the ZC; and control the target train to travel in the RRM mode according to the RRM mode instruction and the movement instruction, receiving a movement prohibition instruction which is sent by the ZC if segment occupancy information includes information indicating that a front section within an automatic protection range is occupied, wherein when the position of the target train is lost and the target train is in the emergency-brake-stop state, the automatic protection range is a first automatic protection range, and the first automatic protection range is an overlapped part between an estimated range of the first automatic protection range and a range indicated by Movement Authority (MA) of the target train prior to loss of the position of the target train, the estimated range being determined based on an estimated train stop position; and when the target train is in the RRM mode, the automatic protection range is between a largest position of the first automatic protection range and a position of a front platform, controlling, according to the movement prohibition instruction, the target train to perform an emergency brake to stop.

11. The device of claim 10, wherein the RRM mode indicates that the target train, under remote control by the TIAS, is controlled to enter the front platform at a speed within a speed limit range.

12. The device of claim 10, wherein after controlling the target train to travel in the RRM mode, the method further comprises:

determining that a switch condition for re-entering the FAM mode is satisfied, and switching an operation mode of the target train to the FAM mode.

13. The device of claim 12, wherein the switch condition includes one or more of:

the position of the target train is reacquired, Movement Authority (MA) information sent by the ZC is received, authorization information for fully automatic driving sent by the TIAS is received, a preset driving mode with a highest automation level is the FAM mode, no communication failure is present in a Vehicle on-board Controller (VOBC), and the target train is released from the emergency-brake-stop state.

14. The device of claim 10, wherein the train message further includes one or more of:

a position identifier indicating that the position of the train is lost, direction information, activation end information, an operation mode prior to loss of position, a train operation level, state information indicating that the target train is in the emergency-brake-stop state, and a reason for emergency brake.

* * * * *